US010021480B2

(12) United States Patent
Lobisser et al.

(10) Patent No.: US 10,021,480 B2
(45) Date of Patent: Jul. 10, 2018

(54) INTEGRATED SPEAKERS

(71) Applicant: Apple Inc., Cupertino, CA (US)

(72) Inventors: G. Kyle Lobisser, Los Altos Hills, CA (US); Jason S. Keats, Castro Valley, CA (US); Ryan J. Mihelich, Morgan Hill, CA (US); Pablo Seoane Vieites, San Jose, CA (US); Kevin M. Kenney, San Jose, CA (US); John Raff, Menlo Park, CA (US); Erik A. Uttermann, Cupertino, CA (US); Melody L. Kuna, Cupertino, CA (US); Oliver C. Ross, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 329 days.

(21) Appl. No.: 14/495,777

(22) Filed: Sep. 24, 2014

(65) Prior Publication Data

US 2016/0088379 A1 Mar. 24, 2016

(51) Int. Cl.
*H04R 1/02* (2006.01)
*H04R 1/28* (2006.01)

(52) U.S. Cl.
CPC ..... *H04R 1/2888* (2013.01); *H04R 1/2834* (2013.01); *H04R 2201/029* (2013.01); *H04R 2499/11* (2013.01)

(58) Field of Classification Search
CPC .... H04R 1/2888; H04R 1/2834; H04R 1/026; H04R 1/02; H04R 1/2892; H04R 1/2896;
(Continued)

(56) References Cited

U.S. PATENT DOCUMENTS 7,990,723 B2 8/2011 Watanabe et al.
8,351,631 B2 * 1/2013 Lee ..... H04R 1/2819 381/338

(Continued)

FOREIGN PATENT DOCUMENTS

JP 2004088224 3/2004
JP 2006140734 6/2006

(Continued)

OTHER PUBLICATIONS

PCT Application No. PCT/US2015/043208—International Search Report & Written Opinion dated Nov. 11, 2015.

(Continued)

*Primary Examiner* — Matthew Eason
*Assistant Examiner* — Sabrina Diaz
(74) *Attorney, Agent, or Firm* — Brownstein Hyatt Farber Schreck, LLP

(57) ABSTRACT

An enclosure for an electronic device is enclosed. The enclosure includes rib structures configured to improve structural support to prevent damage and to dissipate vibration throughout the enclosure. The rib structure can receive a speaker module and a cap member. The rib structure and the speaker module can combine to form a three-dimensional volume allowing the speaker module in which the speaker module may project sound, thereby enhancing acoustic performance. Also, the cap member may be adhesively attached to the rib structure to provide additional structural support against vibration and abuse caused by load forces associated with a drop event.

20 Claims, 12 Drawing Sheets

(58) Field of Classification Search
CPC ..... H04R 1/2869; H04R 1/2873; H04R 2201/029; H04R 2499/10; H04R 2499/11; H04R 2499/15
USPC ..... 381/87, 332–335, 386
See application file for complete search history.

(56) References Cited

U.S. PATENT DOCUMENTS

| | | | | |
|---|---|---|---|---|
| 9,176,540 | B2 * | 11/2015 | Shin | H04M 1/035 |
| 2006/0126870 | A1 * | 6/2006 | Wu | H04R 1/345 381/306 |
| 2008/0298608 | A1 * | 12/2008 | Wilcox | H03F 3/20 381/120 |
| 2010/0091442 | A1 * | 4/2010 | Theobald | G06F 1/1616 361/679.09 |
| 2011/0019855 | A1 | 1/2011 | Lee et al. | |
| 2012/0099745 | A1 | 4/2012 | Chen | |
| 2012/0170189 | A1 | 7/2012 | Li et al. | |
| 2013/0170688 | A1 | 7/2013 | Cohen et al. | |
| 2014/0023223 | A1 * | 1/2014 | Hwang | H04R 1/025 381/386 |
| 2014/0177902 | A1 * | 6/2014 | Yeh | H04R 1/227 381/394 |

FOREIGN PATENT DOCUMENTS

| | | | |
|---|---|---|---|
| JP | 2008205582 | A | 9/2008 |
| JP | 2012195806 | | 10/2012 |
| KR | 1020110010999 | A | 2/2011 |

OTHER PUBLICATIONS logv_to, "Taking iPhone 6 Plus to Pieces with Swift Attach and Disclosuing Sparkly and Gorgeous Inside of It," Gigazine, Japan, http://gigazine.net/news/20140919-ifixit-iPhone-6plus/, 33 pages, Sep. 19, 2014.

* cited by examiner

INTEGRATED SPEAKERS

FIELD

The described embodiments relate generally to an enclosure of an electronic device. In particular, the present embodiments relate to structural features which enhance the strength and rigidity of the enclosure as well as provide acoustic enhancements.

BACKGROUND

Enclosures provide structural support for electronic devices. Generally, enclosures are made from stiff materials to protect against damage to internal components (e.g., processors) as well as external components (e.g., cover glass). Damage to components may occur from several events, such as dropping the device. In order to maintain the structural rigidity of relatively large electronic devices, the enclosures may be formed with greater thickness.

However, enclosures having greater thickness may offer less internal space for components. Further, additional thickness corresponds to additional material which may increases the cost of the electronic device. Additional thickness also corresponds to additional weight of the device which is generally undesirable, especially portable electronic devices. On the other hand, electronic devices with relatively thin enclosures may feel flimsy to a user and offer less structural support and less resistance to damage. Further, a speaker module within the electronic device may project sound at a frequency equal to the resonant frequency of the material of the enclosure, causing unwanted vibration throughout the enclosure.

SUMMARY

In one aspect, an enclosure for an electronic device is described. The enclosure may include a plurality of ribs defining a rib structure extending along a rear portion of the enclosure. In some embodiments, the plurality of ribs includes a first portion engaged with a sidewall of the enclosure. In some embodiments, the first portion receives an audio device. The plurality of ribs may further include a second portion different from the first portion. In some embodiments, the second portion receives a cap member. Also, in some embodiments, the plurality of ribs includes a first rib that is shared by the first portion and the second portion.

In another aspect, an enclosure for an electronic device is described. The enclosure may include several sidewalls integrally formed around an outer peripheral portion of the enclosure. The several sidewalls may include a first wall having a first aperture and a second aperture. The enclosure may further include a first plurality of ribs integrally formed on a rear portion of the enclosure to define a first portion and a second portion. In some embodiments, the first portion is adapted to receive a first component on a first flange member positioned within the first portion. Also, in some embodiments, the second portion is adapted to receive a second component on a second flange member positioned within the second portion. The enclosure may further include a second plurality of ribs different from the first plurality of ribs. In some embodiments, the second plurality of ribs is integrally formed on the rear portion of the enclosure to define a third portion and a fourth portion. In some embodiments, the third portion is adapted to receive a third component on a third flange member positioned within the third portion. Also, in some embodiments, the fourth portion is adapted to receive a fourth component on a fourth flange member positioned within the fourth portion. In some embodiments, both the first plurality of ribs and the second plurality of ribs engage the first wall. In some embodiments, the first aperture opens into the first portion. In some embodiments, the second aperture opens into the third portion.

In another aspect, a method for forming an enclosure of an electronic device is described. The method may include removing a portion of an aluminum substrate to form a plurality of sidewalls; the plurality of sidewalls may have a first sidewall. The method may further include removing a portion of the plurality of sidewalls to define a location that receives a cover glass. The method may further include removing a portion of the aluminum substrate to define a rib structure having a first rib and a second rib. In some embodiments, the first rib and second rib are adapted to receive an audio device and a cap member. In some embodiments, the first rib and the second rib both engage the first sidewall. The method may further include removing a first aperture in the first sidewall; first aperture may open into a location between the first rib and the second rib.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
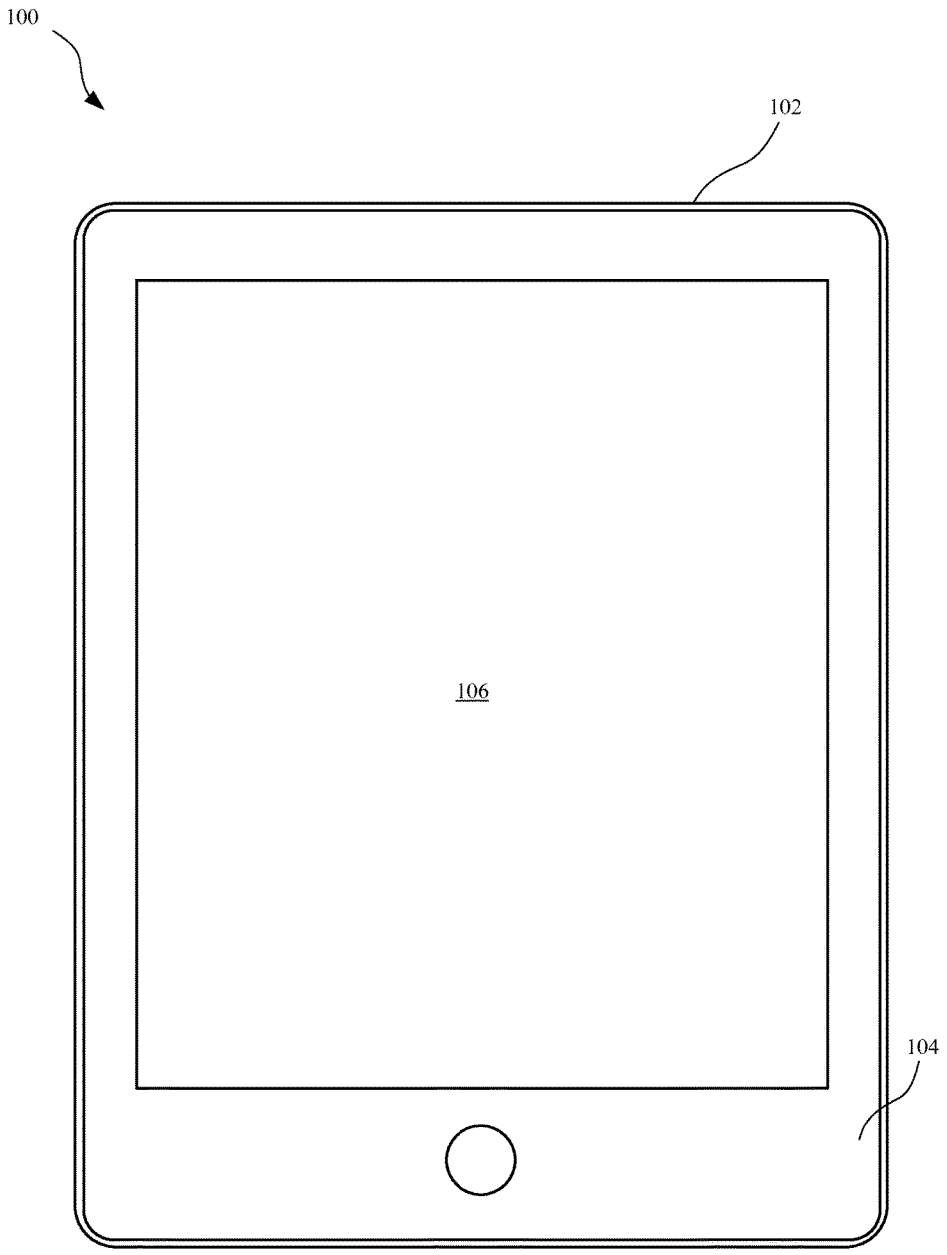
FIG. 1 illustrates an electronic device in accordance with the described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to an enclosure of an electronic device. The enclosure may be formed from a unitary substrate of a metal, such as aluminum, with several portions of the substrate removed by machining the substrate. Removal means may include a computer numeric control ("CNC") machine and/or a water jet. The remaining portions of the substrate after the removal process may be referred to as "integrally formed" with the enclosure. Alternatively, the enclosure may be formed by additive manufacturing processes. For instance, a printer, such as a three-dimensional printer, capable of printing multiple, stacked layers of resin material may be used to print the enclosure with integrally formed ribs.

Some portions of the substrate may be removed to form rib structures which may serve several functions. For example, the rib structures may extend along a rear portion of the enclosure and improve the structural rigidity of the enclosure, making the enclosure more resistant to bending. Also, the rib structures may be integrally formed with a sidewall of the enclosure. This allows the rear portion to include an increased size (e.g., length and/or width) while maintaining a relatively small thickness, such as 1-2 millimeters ("mm") or less. These integrally formed rib structure provides resistance to bending and/or twisting of the enclosure which may prevent damage to the electronic device or some of its components. Also, the rib structure provides additional resistance against drop events, such as when a user drops the electronic drive. For instance, the load, or force, incurred by the electronic device during a drop event may be distributed by the rib structure throughout the enclosure rather than a localized area associated with a location in which the electronic device collides with a surface.

The rib structure may also be adapted to, or designed to, receive an audio device (e.g., speaker module) and a cap member. The cap member may be formed from a composite material that includes, for example, carbon fiber. The composite material may include other forms of fibers. In either event, the fibers may be aligned with a critical load path, defined as the direction or orientation of a load, or force, received by the electronic device during a drop event. The cap member may be adhesively secured to the rib structure, thereby providing additional resistance against drop events. To provide additional support, the cap member may include one or more protrusions adhesively secured to the rear portion of the enclosure. Adhesively securing the cap member, including protrusions, to the enclosure also provides added stiffening strength. The cap member may not only absorb some of the force received from the drop event, but also stabilize the rib structure by preventing or limiting movement of the rib structures during the drop event. Also, the cap member and the rib structure (and in some cases, the audio device) may combine to form an enclosed volume or region of air which serves as a "back volume" for the audio device, allowing the audio device to project some sound through the back volume, thereby enhancing the audio quality of the electronic device. In instances where an electronic device includes multiple audio devices, there may be an associated back volume configured to allow the multiple audio devices to emit sound from the electronic device having the same sound levels (e.g., in decibels). As a result, the user may experience a consistent sound from the electronic device.

In some cases, the enclosure may include a material having an associated resonant frequency, or resonant frequencies. Sound emitted from the audio device at the resonant frequency may cause or drive relatively high vibrations through the enclosure in an unwanted manner. However, the back volume described above may be designed to reduce or dampen these frequencies emitted by the audio device. For instance, the enclosed volume of air may allow the sound energy to dissipate before extending throughout the enclosure. Further, the composite material forming the cap member may absorb sound energy. In this manner, the audio device can emit sound having a range of frequencies, including one or more resonant frequencies of the material of the enclosure, without causing unwanted vibration due to a resonant moment associated with a period in which the audio device emits sound at the resonant frequency. Further, some electronic devices may include several audio devices. In this case, the enclosure may include additional rib structures and cap members corresponding to the number of audio devices. The design and layout of each rib structure coupled with the design of each cap member and protrusions thereof create an electronic device having multiple audio devices that drive sound at approximately the same sound levels, creating electronic device with a consistent sound.

These and other embodiments are discussed below with reference to FIGS. 1-19. However, those skilled in the art will readily appreciate that the detailed description given herein with respect to these Figures is for explanatory purposes only and should not be construed as limiting.

FIG. 1 illustrates an embodiment of an electronic device 100. In some embodiments, electronic device 100 is a tablet computing device, such as an iPad® from Apple Inc., of Cupertino, Calif. In other embodiments, electronic device 100 is mobile communications device, such as a smartphone. Electronic device 100 includes enclosure 102 that receives cover glass 104. In some embodiments, enclosure 102 is made from a metal, such as aluminum. Display panel 106 may be positioned between enclosure 102 and cover glass 104, and also be capable of driving visual display content visible through cover glass 104.

Figure 2:
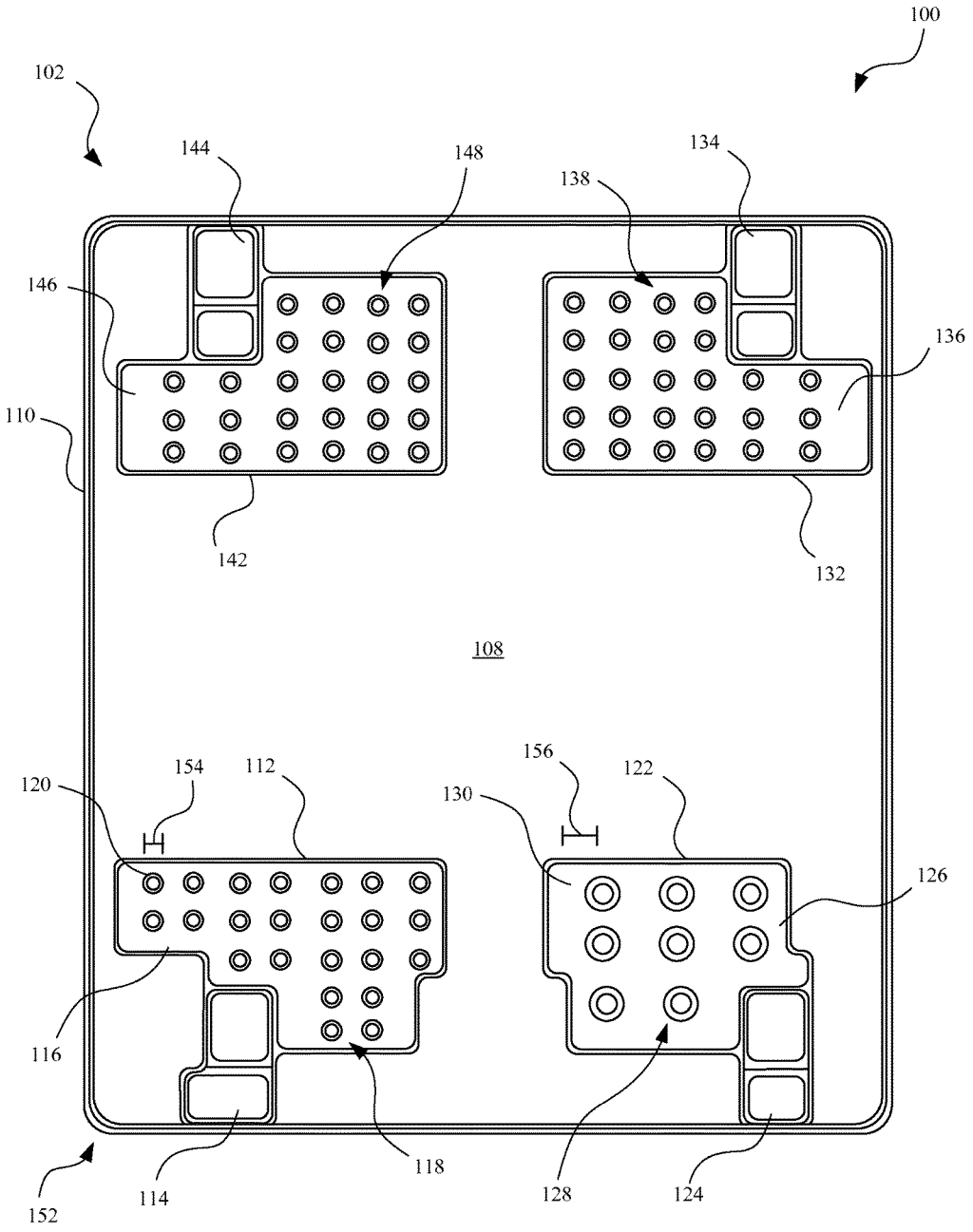
FIG. 2 illustrates the electronic device shown in FIG. 1 with the cover glass, display panel, and internal components removed, in accordance with the described embodiments.

FIG. 2 illustrates a top view of electronic device 100 with the cover glass and display panel removed. Also, for purposes of clarity and simplicity, several internal components (e.g., processors, batteries, memory device, etc.) have been removed to show rear portion 108 and sidewalls 110. It should be understood that rear portion 108 is only intended for purposes of description and is not intended to demarcate a precise location of enclosure 102. Rear portion 108 may generally be associated with a portion of enclosure 102 within sidewalls 110. Also, sidewalls 110 generally represent a four-side sidewall structure on the outer peripheral portion of enclosure 102.

Enclosure 102 includes several rib structures positioned on rear portion 108. Each of the rib structures is capable of receiving both an audio device and a cap member. For example, first rib structure 112 includes first audio device 114 and first cap member 116. In some embodiments, first rib structure 112 is adhesively secured to enclosure 102. In the embodiment shown in FIG. 2, first rib structure 112 is formed from a machining process (e.g., CNC tool, water jet machine) configured to remove material from enclosure 102 to form first rib structure 112. In other words, first rib structure 112 is integrally formed with enclosure 102 and accordingly, made from the same material as enclosure 102. First rib structure 112 may also be referred to as several ribs integrally formed to define a multi-sided structure. First rib structure 112 may provide structural support as well as resistance to bending and/or twisting of enclosure 102, particularly in instances where rear portion 108 is relatively thin (e.g., approximately 1 mm).

Also, first audio device 114 is positioned within first rib structure 112 and electrically connected to an internal component, such as an audio processor (not shown). In some embodiments, first audio device 114 is a speaker module having a passive radiator and capable of emitting sound. First audio device 114 may be configured to drive sound from electronic device 100 to be heard by a user. Sounds may derive from, for example, a ring tone, an audio file, or a video file, all of which may be stored in a memory device (not shown) within electronic device 100.

First cap member 116 is also positioned on first rib structure 112 and generally positioned proximate to first audio device 114. In some embodiments, first cap member 116 is adhesively secured to a portion of first rib structure 112. Also, in some embodiments, first cap member 116 is made from a metallic material or a metal alloy. In the embodiment shown in FIG. 2, first cap member 116 is a composite structure made from materials including carbon fiber. Generally, first cap member 116 may be made from any material preferably having a relatively low weight and relatively high specific stiffness. Further, cap member 116 may generally include any material or materials having high specific stiffness and good damping characteristics, including but not limited to homogeneous alloys or highly orthotropic composite materials. This allows cap member 116 to contribute to the rigidity of enclosure 102 while also reducing some acoustic effects associated with the audio devices. Also, first cap member 116 may be cut from a large sheet of the composite material in a manner that fits within a rib structure, such as first rib structure 112. Also, in some embodiments, first cap member 116 includes several protrusions 118, which include first protrusion 120, extending from surface of first cap member 116 to rear portion 108. In some embodiments, protrusions 118 are adhesively secured to rear portion 108, which will be shown later. First cap member 116 and first rib structure 112 combine to form a semi-hollow enclosed volume or region of air, also referred to as a back volume, through which first audio device 114 may project sounds waves in order to enhance or increase acoustic performance. This will be shown and discussed later in further detail.

Figure 3:
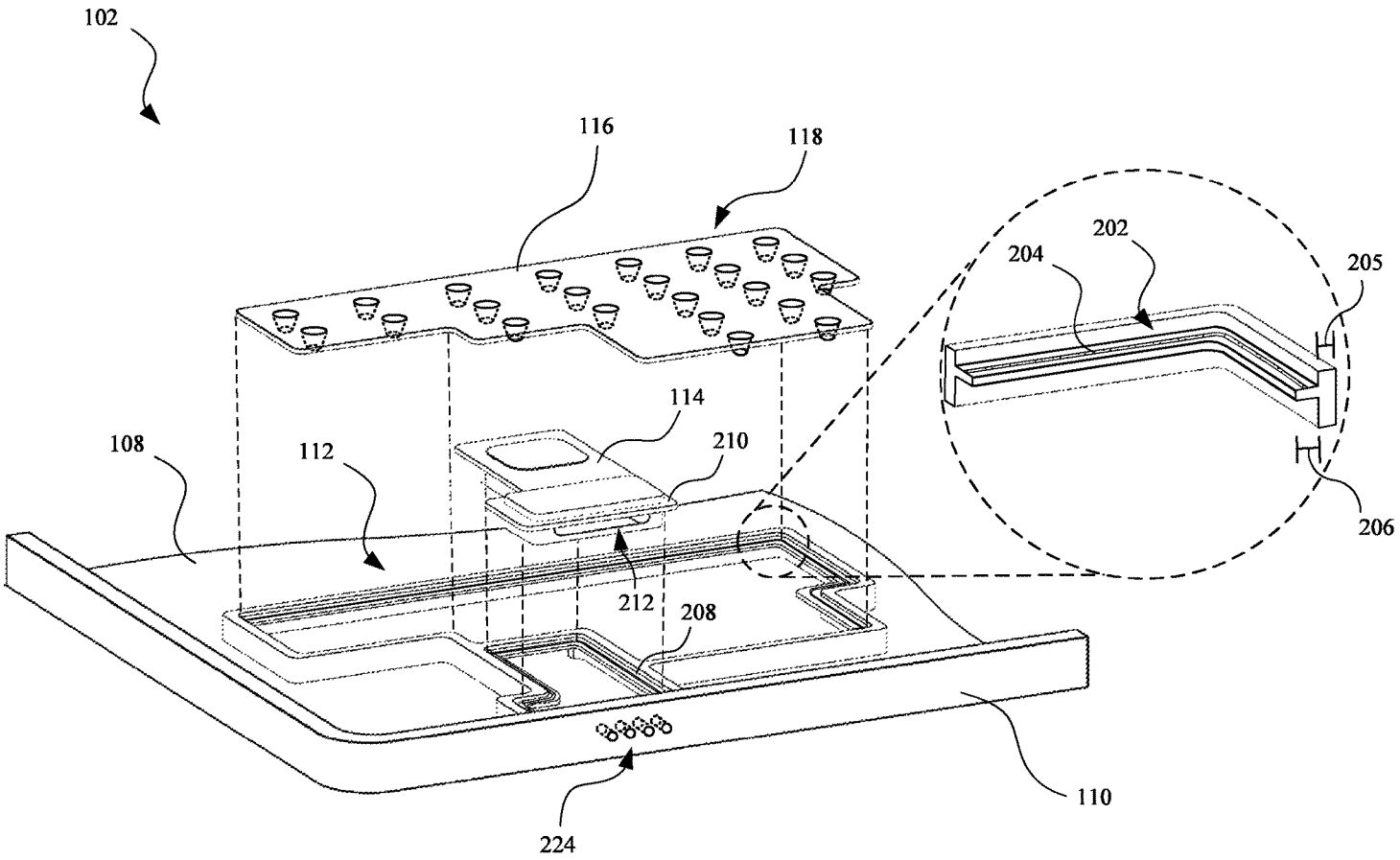
FIG. 3 illustrates an isometric view of an enlarged view of the enclosure in FIG. 2 showing features of a rib structure, in accordance with the described embodiments.

FIG. 3 illustrates an exploded view of an enlarged portion of enclosure 102 showing first rib structure 112 receiving first audio device 114 in a first portion of first rib structure 112 and first cap member 116 in a second portion. First cap member 116 and protrusions 118 may be adhesively secured to first rib structure 112. While each of protrusions 118 are adhesively secured to rear portion 108 of enclosure 102, first cap member 116 may be adhesively secured to flange member 202 within first rib structure 112. An enlarged view showing a portion of first rib structure 112 show flange 202 generally horizontal and capable of receiving adhesive 204. Flange member 202 may be formed during the material removal process previously described for forming first rib structure 112. First rib structure 112 may include length or thickness 205 approximately in the range of 0.8 to 3 mm. Also, flange 202 may have a length 206 approximately in the range of 1-3 mm, and preferably at least 1.5 mm to provide adhesive 204 with a sufficient area as well as provide a sufficient area for first cap member 116 to adhesively secure to first rib structure 112. Flange 202 may include a substantially uniform thickness 206 through first rib structure 112. Also, adhesive 204 may be selected from methacrylate, exopy, or pressure sensitive adhesive ("PSA"). In the embodiment shown in FIG. 3, adhesive 204 is urethane.

First audio device 114 may be secured to first rib structure 112 in several ways. For example, in some embodiments, first audio device 114 includes a bead made from a compressible material that fits into a mechanical clip positioned within first rib structure 112. In the embodiment shown in FIG. 3, first audio device 114 is adhesively secured to first rib structure 112 in a manner similar to first cap member 116, i.e., by using a flange member 208 within first rib structure 112 to adhesively secure to flange member 210 of first audio device 114. Also, in order for sound to escape electronic device 100, sidewall 110 may include an apertures 224, commonly referred to as a speaker grill, allowing sound to pass from first opening 212 of first audio device 114. It will be appreciated that other configurations of cap member and audio devices (e.g., shown in FIG. 2) may include substantially all of the features associated with first rib structure 112, such as securing means of an audio device and a cap member to rib structures.

Figure 4:
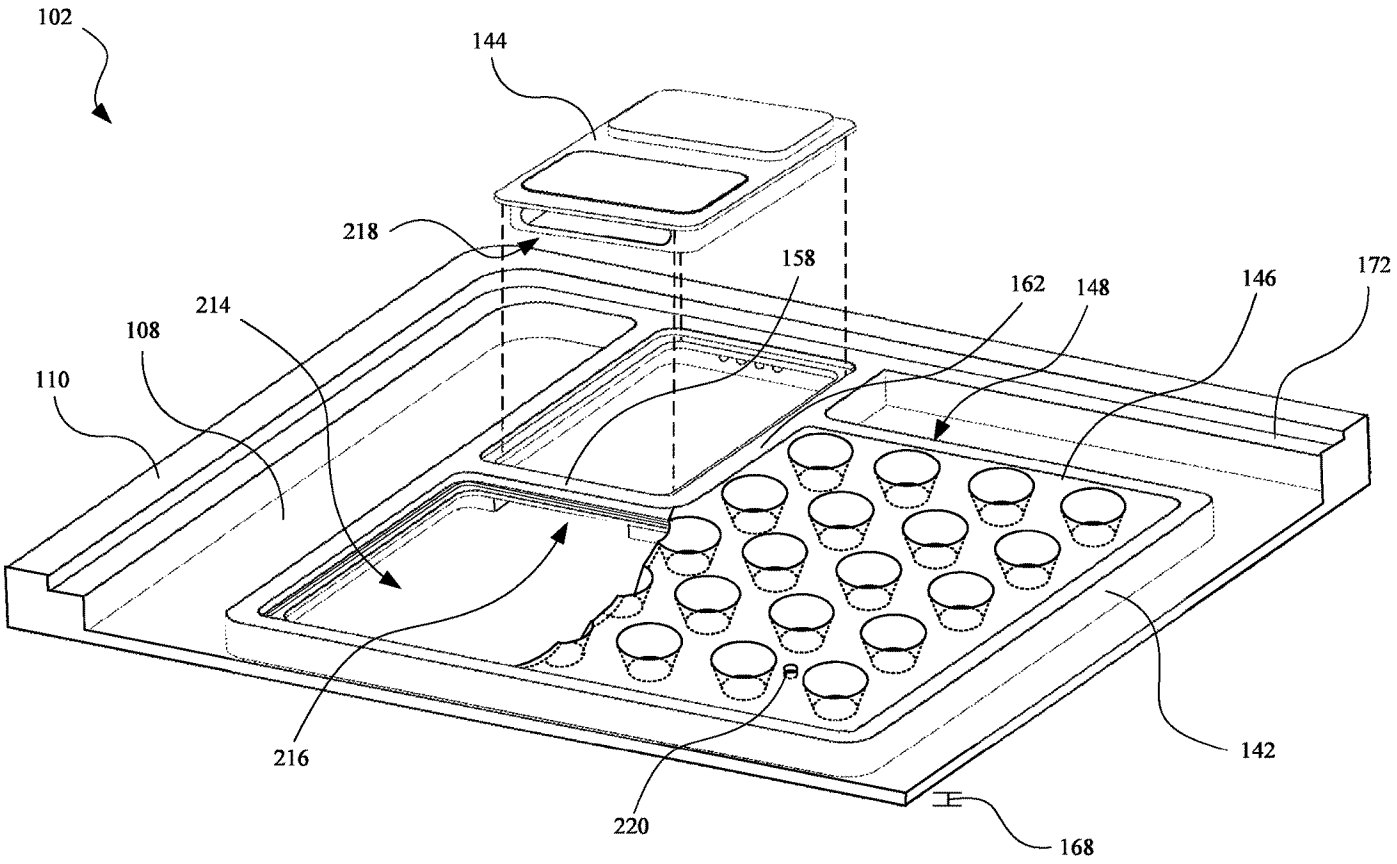
FIG. 4 illustrates an isometric view of an enlarged portion of the enclosure in FIG. 2 showing features another rib structure, in accordance with the described embodiments.

When the audio devices and cap members are secured to the rib structures, an acoustic seal may be formed between individual rib structures and their respective cap member. For example FIG. 4 illustrates an enlarged view of a portion of enclosure 102 showing fourth cap member 146 (shown in FIG. 2) adhesively secured to fourth rib structure 142. For purposes of illustration, a portion of fourth cap member 146 is not shown in order to illustrate an additional feature. Back volume 214 may be defined as a space or region enclosed between fourth rib structure 142 and fourth cap member 146 (including protrusions 148). In this regard, when fourth audio device 144 is secured to fourth rib structure 142, an acoustic seal may be formed and air within back volume 214 may be substantially trapped. As such, air will generally not escape when fourth audio device 144 projects sound into back volume 214. Also, fourth rib structure 142 may include first rib 158, which includes a portion of material removed to define an underpass 216. In other embodiments, fourth rib structure includes underpass 216 within second rib 162. Still, in other embodiments, fourth rib structure 142 includes an underpass within both first rib 158 and second rib 162. Generally, underpass 216 may formed in a location of fourth rib structure 142 such that underpass 216 opens to a first portion and a second portion of fourth rib structure 142 share a rib, where the first portion and the second portion receive fourth audio device 144 and fourth cap member 146, respectively. In some embodiments, underpass 216 is formed by a removal tool such as a T-cutter (not shown). In this manner, when fourth audio device 144 is secured to fourth rib structure 142, first audio device 144 may project sound waves, via second opening 218, into back volume 214, via underpass 216, in order to enhance or increase acoustic performance.

Also, because the acoustic seal may substantially trap air within the back volumes, issues may arise when an electronic device is subjected to different altitudes. In instances when the electronic device is carried on a commuter jet plane, which may reach altitudes of 30,000 feet or more, air pressure within back volume 214 may substantially decrease, causing fourth cap member 146 break the adhesive bond between with rib structure 142 and at least partially decouple. In order to prevent this, in some embodiments, fourth cap member 146 includes vent 220. Vent 220 may be any opening positioned anywhere on fourth cap member 146, and in some cases between protrusions 148, allowing some air movement into and out of back volume 214. Vent 220 includes a diameter approximately in the range of 0.2 to 0.5 mm. Generally, vent 220 includes a diameter small enough not to allow a substantial amount of air to pass into and out of during periods of decreased and increased elevation, respectively. It will be appreciated that a vent may be formed in a similar manner to other cap members within the electronic device.

FIG. 4 further shows rear portion 108 having thickness 168. Thickness 168 may be approximately in the range of 0.4 to 2 mm. Also, rear portion 108 may include a substantially uniform thickness 168. In order to receive a cover glass (shown in FIG. 1), in some embodiments, enclosure 102 includes surface 172 formed form a material removal process previously described. Surface 172 may extend around enclosure 102 in a manner similar to that of side wall 110, and is designed to receive the cover glass.

Referring again to FIG. 2, in some cases, first audio device 114 may project sound waves into an associated back volume (previously described) at a frequency equal to a resonance frequency of the material forming enclosure 102. As a result, enclosure 102, including rear portion 108, may respond by vibrating at the resonant frequency which includes an amplitude greater than that of the amplitude associated with the frequency of sound waves produced by first audio device 114. In some cases, this vibration can be felt by a user holding electronic device 100, creating an undesirable user experience. To dampen, or reduce, the effects of the resonant frequency vibrating enclosure 102, first rib structure 112, first cap member 116, and protrusions 118 may combine to absorb some of the energy associated with the sound waves causing the resonant frequency. For instance, a back volume enclosed by rear portion 108, first rib structure 112, first cap member 116, and protrusion 118 may receive the sound waves to pass and allow the energy associated with the sound waves to dissipate when contacting the aforementioned structures. Also, first cap member 116 may further dissipate the energy, particularly in instances when first cap member 116 is formed from fibers. For example, the sound waves may be dissipated by traversing between the fibers within first cap member 116. These features allow enclosure 102 to acoustically decouple from portions of enclosure 102 associated with first audio device 114, such as a portion contained by first rib structure 112. It should be understood that these features may be associated with other audio devices within enclosure 102. In this manner, the user experience may be improved as resonance frequencies, or resonant moments, produced by audio devices are generally unnoticed by the user.

Electronic device 100 may include additional rib structures also capable of receiving audio devices and cap members. In some embodiments, electronic device 100 includes a pair of rib structures, audio devices, and cap members. In other embodiments, electronic device 100 includes three rib structures, audio devices, and cap members. In the embodiment shown in FIG. 2, electronic device 100 includes four rib structures, audio devices, and cap members. In addition to the aforementioned rib structure, audio device, and cap member, electronic device 100 further includes second rib structure 122, third rib structure 132, and fourth rib structure 142 that receiving second audio device 124, third audio device 134, and fourth audio device 144, respectively. Also, second rib structure 122, third rib structure 132, and fourth rib structure 142 receive second cap member 126, third cap member 136, and fourth cap member 146, respectively. Also, shown in FIG. 2, second cap member 126 includes protrusions 128, third cap member 136 includes protrusions 138, and fourth cap member 146 includes protrusions 148. These structures may include any feature similar to those previously described. For example, third rib structure 132 may act in concert with third cap member 136 to further allow enclosure 102 to acoustically decouple from locations of enclosure 102 associated with third audio device 134, such as a portion contained by third rib structure 132. Also, second rib structure 122, third rib structure 132, and fourth rib structure 142 may provide additional structural support and additional resistance to bending and/or twisting of enclosure 102. This may further allow for a decreased thickness of rear portion 108 of enclosure 102 to create additional space within electronic device 100 and/or reduce the cost of materials used.

Also, electronic devices, such as electronic device 100, are susceptible to damage, particularly during a drop event, such as when a user drops the electronic device on a relatively hard or dense surface. These drop events may cause a load force within electronic device 100 sufficient to cause cover glass 104 (shown in FIG. 1) to mechanically decouple from enclosure 102. In particular, electronic device 100 may be more susceptible to decoupling in instances when a corner, such as first corner 152, of electronic device 100 collides with a hard surface. However, in addition to providing the desired acoustic effects previously discussed, first rib structure 112 is further capable of dissipating at least some of the load force incurred during the drop event. In particular, a drop event may deliver a force to sidewalls 110 which may cause the decoupling of the cover glass. However, first rib structure 112 is configured to channel or distribute the force associated with the drop event to other portions of enclosure 102, such as rear portion 108, which may be better suited to dissipate the force. Further, when first cap member 116 is positioned in and secured (e.g., by adhesives) to first rib structure 112, electronic device 100 may withstand additional load force. Further, protrusions 118, when adhesively attached to rear portion 108 of enclosure 102, add additional stiffness and rigidity to enclosure 102 by minimizing movement of first cap member 116 during the drop event. In this manner, electronic device 100 may be provided with sufficient support to prevent mechanical decoupling of components, such as cover glass 104, from enclosure 102. It should be understood that other rib structures, cap members, and protrusions of cap member provide may include substantially similar features and advantages previously described for first rib structure 112, first cap member 116 and protrusions 118, all of which improve the strength and integrity of electronic device 100 by providing additional resistance against drop events.

The rib structures, audio devices, cap members (including protrusion) may include different shapes. For example, FIG. 2 illustrates first rib structure 112 having a two-dimensional shape different from second rib structure 122 corresponding to different two-dimensional areas. Accordingly, first cap member 116 includes a different two-dimensional shape than that of second cap member 126. Also, first audio device 114 includes a different two-dimensional shape than that of second audio device 124. Differences in shapes may be due in part to constraints within electronic device 100. For example, first rib structure 112 and second rib structure 122 may be designed to allow internal components (e.g., processor, main logic board, memory, battery, wiring, etc.) to pass around and/or between first rib structure 112 and second rib structure 122. This may allow for optimal positioning of internal components and/or to provide structural support to enclosure 102 in specific or unique locations. In other embodiments, the rib structures are substantially similar in shape.

Structural differences, however, may correspond to acoustical differences. For example, first audio device 114 may project sound waves into back volume 214 (shown in FIG. 4) in a manner different from sound waves projected from second audio device 124 into a back volume defined by a volume enclosed between second rib structure 122 and second cap member 126. In this regard, FIG. 2 shows first cap member 116 having protrusions 118 having a different size than protrusions 128 of second cap member 126 such that the back volumes associated with first audio device 114 and second audio device 124 are substantially similar. In other words, back volume 214 may include a three-dimensional volume similar to that of the back volume associated with second audio device 124. This may allow first audio device 114 to deliver a similar volume level (e.g., decibel level) to a user as that of second audio device 124. In order to form similar back volume dimensions from different associated audio devices, in some embodiments, the shapes of protrusions 118 are different from protrusions 128. For example, in some embodiments, protrusions 118 include four-sided configurations while protrusions remain substantially circular. In the embodiment shown in FIG. 2, an exemplary first protrusion 120 includes a diameter 154 smaller than diameter 156 of an exemplary second protrusion 130. Further, first cap member 116 includes a different number of protrusions 118 than protrusions 128 of second cap member 126. Also, to produce a desired acoustical effect (e.g., similar volumes from different audio devices), in some embodiments, the protrusions of the cap members are not aligned in rows and/or columns. In the embodiment shown in FIG. 2, both first cap member 116 and second cap member 126 include protrusions 118 and protrusions 128, respectively, aligned in rows and columns. It should also be noted that overall structures combining to form the back volumes are structured to compensate for differences in size or audio capabilities of audio speakers such that electronic device distributes a consistent volume through multiple audio devices. Accordingly, electronic device 10 may include audio devices having substantially similar sizes, or at least one audio device (e.g., first audio device 114) may differ.

FIG. 2 further shows both first rib structure 112 and second rib structure 122 having different two-dimensional shapes than third rib structure 132 and fourth rib structure 142. Such differences may be for any reason previously described for differences between first rib structure 112 and second rib structure 122 (e.g., constraints due to other internal components). However, third rib structure 132 and fourth rib structure 142 coupled with third cap member 136 and fourth cap member 146, respectively, are designed to cooperate with third audio device 134 and fourth audio device 144, respectively, such that third audio device 134 and fourth audio device 144 deliver a substantially similar volume level as that of first audio device 114 and second audio device 124. In this manner, the four audio devices 114, 124, 134, and 144 cooperate to provide electronic device 100 having a substantially similar level to provide consistent user experience in terms of sound.

In the embodiment shown in FIG. 2, the rib structures, audio devices, and cap member are positioned at their respective corners of electronic device 100. However, these structures and components may be positioned in other areas (e.g., proximate to a midpoint of a sidewall) which may be suitable to accommodate for various internal components or to offer improved audio quality. The cutting tool (e.g., CNC tool) may be easily reprogrammed by changing the computer code to cut or remove material from a substrate to form an enclosure. Also, the rib structures are generally linear structures with bends or elbows between adjacent linear structures. In other embodiments, the rib structures may be rounded, or generally circular, for purposes of improving structural support of the enclosure and/or improve audio quality.

Figure 5:
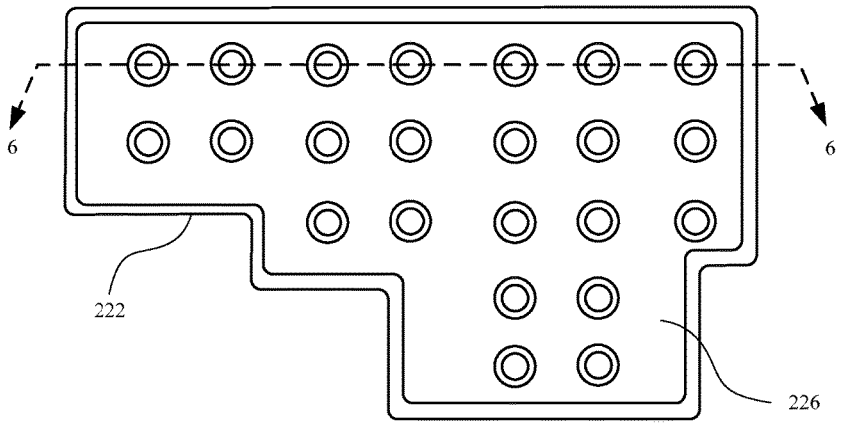
FIG. 5 illustrates a top view of a rib structure receiving a cap member having several protrusions, in accordance with the described embodiments.
Figure 6:
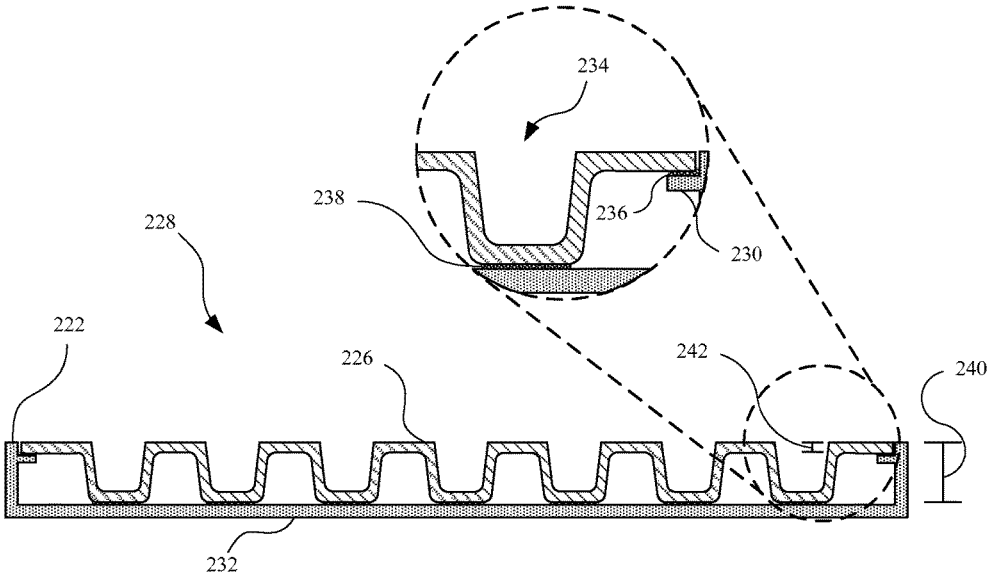
FIG. 6 illustrates a cross sectional view of the rib structure and the cap member shown in FIG. 5 and taken along the line 6-6 to show cap member adhesively secured to rib structure, in accordance with the described embodiments.

An electronic device may include other variations of rib structures and cap members. For example, FIGS. 5 and 6 illustrate an embodiment of an electronic device having rib structure 222 and cap member 226. Cap member 226 may be made from any material previously described for a cap member.

FIG. 5 illustrates a top view of rib structure 222 having cap member 226 positioned within rib structure 222. FIG. 6 illustrates a cross sectional view of cap member 226 shown in FIG. 5, taken along the line 6-6, showing cap member 226 adhesively secured to rib structure 222. As shown in the enlarged view, the outer peripheral region of cap member 226 is adhesively secured to flange 230 of rib structure 222 via adhesive 236, forming part of the acoustic seal previously described.

Protrusions 228 may be adhesively secured to rear portion 232 of rib structure. For example, an exemplary first protrusion 234 shown in the enlarged view is attached to rear portion 232 via adhesive 238. It will be appreciated that all protrusions 228 may be adhesively attached to rear portion 232 in a similar manner. This provides the electronic device with additional structural support as well as resistance to bending, twisting, and/or dropping of the electronic device.

The enlarged view also shows rib structure 222 and cap members 226 having dimensions such that a top surface of cap structure 226 is substantially flush, or co-planar, with respect to rib structure 222. This may be due in part to the positioning of flange 230 formed during a material removal process, the thickness of cap member 226, or a combination thereof. In other embodiments, cap member 226 includes a thickness such that cap member is proud, or extends above, rib structure 222. In this manner, cap member 226 may include electrically conductive materials to form, for example, an electrically conductive path along cap member 226. Alternatively, cap member 226 may be laser etched and subsequently include a conductive adhesive to create a path for electric current.

Cap member 226 generally has a height 240 approximately in the range of 1.2 to 1.8 mm. Further, cap member 226 may include thickness approximately in the range of 0.3 to 0.6 mm, preferably in the range of 0.4 to 0.5 mm. Also, in some embodiments, protrusions 228 are formed by removing material from cap member 226 by, for example, a CNC tool. In the embodiment shown in FIGS. 5 and 6, protrusions 228 are formed by extruding cap member 226 to a desired shape, such as the shape shown. In this manner, cap member 226 remains relatively light (in weight) while minimizing unused or wasted material during a material removal process.

Figure 7:
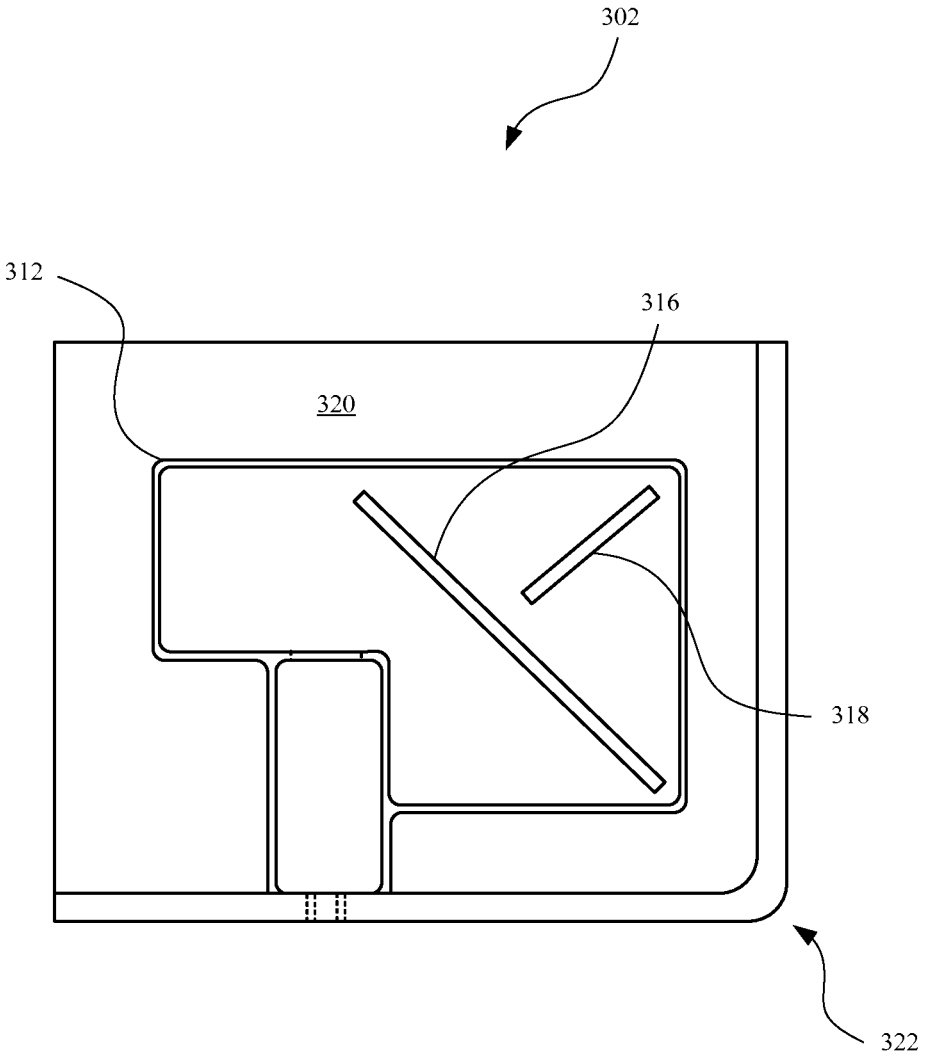
FIG. 7 illustrates a top view of an alternate embodiment of a rib structure having diagonal ribs within the rib structure.
Figure 8:
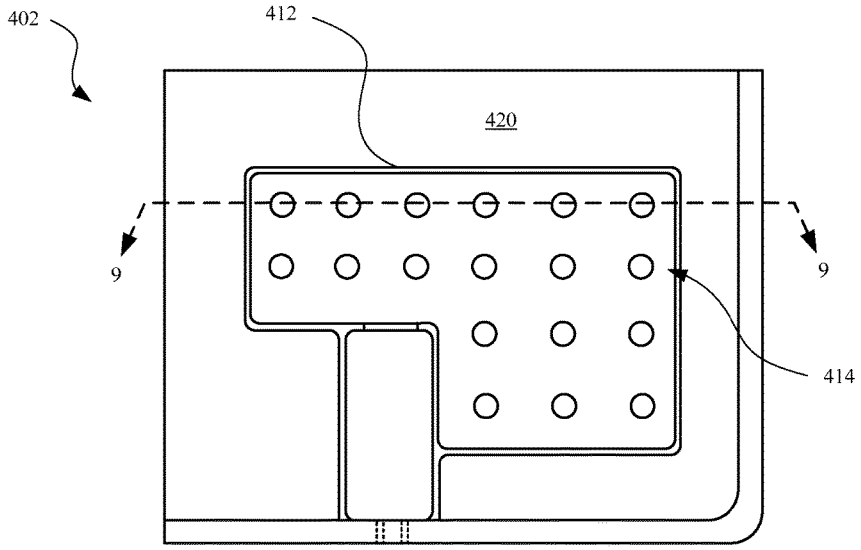
FIG. 8 illustrates a top view of an embodiment of a rib structure bosses within the rib structure, the bosses extending from a rear portion of the enclosure.
Figure 9:
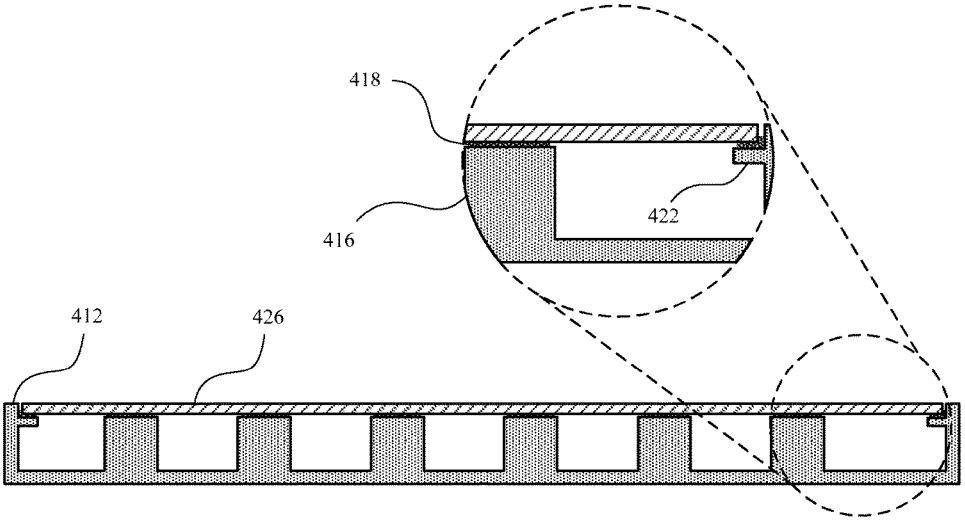
FIG. 9 illustrates a cross sectional view of the rib structure shown in FIG. 8 and taken along the line 9-9 to show cap member adhesively secured to rib structure, in accordance with the described embodiments.

FIGS. 7-9 illustrate embodiments of a cap member providing structural support without having protrusions. FIG. 7 illustrates an enlarged portion of an electronic device having enclosure 302 with rib structure 312 having a portion capable of receiving a cap member (not shown). In this embodiment, rib structure 312 includes first rib 316 and second rib 318 positioned within portion rib structure 312, and extending from a rear portion 320 of enclosure 302. First rib 316 and second rib 318 may be formed from a material removal previously described for forming a rib structure such that first rib 316 and second rib 318 are formed from the same material as that of enclosure 302. First rib 316 may be diagonal with respect to enclosure 302 in order to dissipate a force incurred when dropping the electronic device, particularly when dropped on corner 320. However, first rib 316 may generally take on other shapes to provide a desired structural and/or acoustical support. Second rib 318 may be positioned not only to dissipate load forces incurred on the electronic device, but to also create a back volume to generate desired acoustical characteristics within rib structure 312, e.g., consistent volume with other audio devices within the electronic device.

Also, first rib 316 and second rib 318 may include a height similar to that of protrusions shown in previous embodiments. In this manner, a cap member may be placed within rib structure 312 such that the cap member can be adhesively secured to rib structure 312 as well as first rib 316 and second rib 318. In other embodiments, first rib 316 and second rib 318 are formed from a rigid material (e.g., metal, plastic) and adhesively attached to rear portion 308 of enclosure 302.

FIGS. 8 and 9 illustrate alternate embodiments of an enclosure of an electronic device having a rib structure with several bosses, or protrusions, extending from the rear portion of the enclosure. FIG. 8 illustrates an enlarged portion of an electronic device having enclosure 402 with rib structure 412 and bosses 414 on rear portion 420 of enclosure 402. A cap member is removed to show bosses 414. Bosses 414 may be formed from any material removal process previously describe for a rib structure such that bosses 414 are made from the same material as enclosure 402. In other embodiments, bosses 414 are formed from a rigid material (e.g., metal, plastic) and adhesively attached to rear portion 408 of enclosure 402.

FIG. 9 illustrates a cross sectional view of rib structure 412 taken along the line 9-9. Cap member 426 is added to show securing means to rib structure 412. The enlarged view shows an outer peripheral portion of cap member 426 adhesively secured to flange 422 of rib structure 412. Also, each of bosses 414 may be adhesively attached to cap member 426. For example, first boss 416 is adhesively attached to cap member 426 via adhesive 418.

Despite the configurations shown in FIGS. 7-9, these embodiments may nonetheless be configured to produce an electronic device (e.g., electronic device 100) that includes two or more audio devices coupled to the rib structures which emit sound from the electronic device in a manner previously described, such as outputting similar volume levels.

Figure 10:
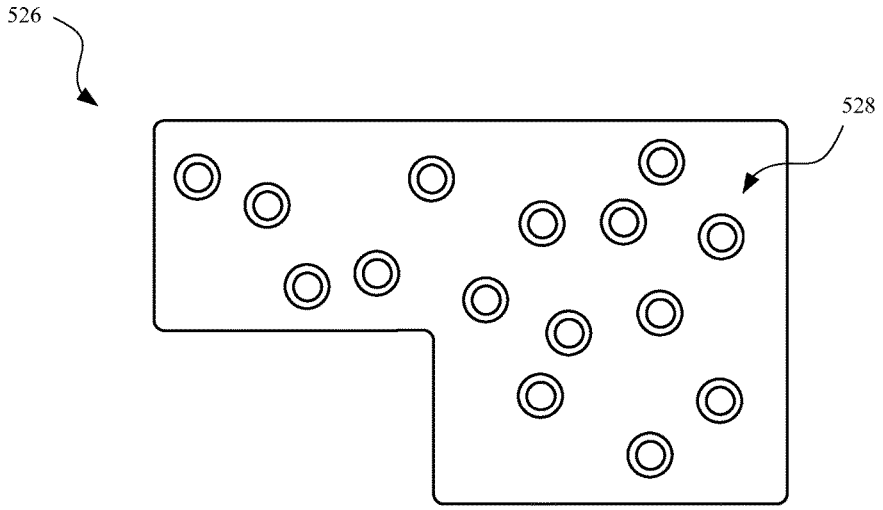
FIG. 10 illustrates an embodiment of a cap member having protrusions positioned in various locations of the cap member.
Figure 11:
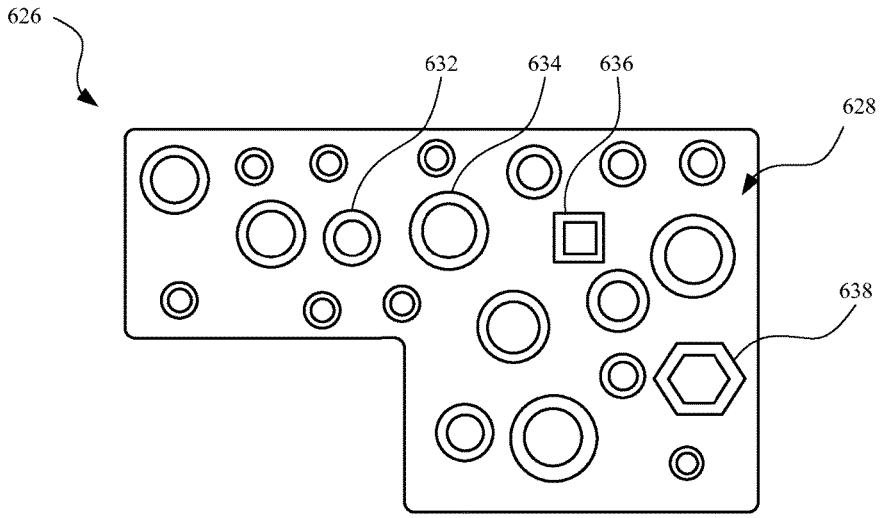
FIG. 11 illustrates an embodiment of a cap member having protrusions of various shapes and sizes, and positioned in various locations of the cap member.

FIG. 10 illustrates a top view of an embodiment of cap member 526 having several protrusions 528 in a relatively non-uniform pattern. In other words, protrusions 528 are not in columns or rows. FIG. 11 illustrates a top view of an embodiment of cap member 626 having several protrusions 628 in a relatively non-uniform pattern, further having protrusions 628 of different shapes and sizes. For example, while first protrusion 632 and second protrusion 634 are substantially circular (from a top view), first protrusion 632 includes a diameter less than that of second protrusion 634. Also, FIG. 11 shows third protrusion 636 having a four-sided configuration while fourth protrusion 638 has a six-sided configuration. FIGS. 10 and 11 are designed to illustrate that protrusions may be formed with various geometrical shapes and sizes which also produce a desired structural support as well as a desired acoustical configuration, both of which are previously described.

Figure 12:
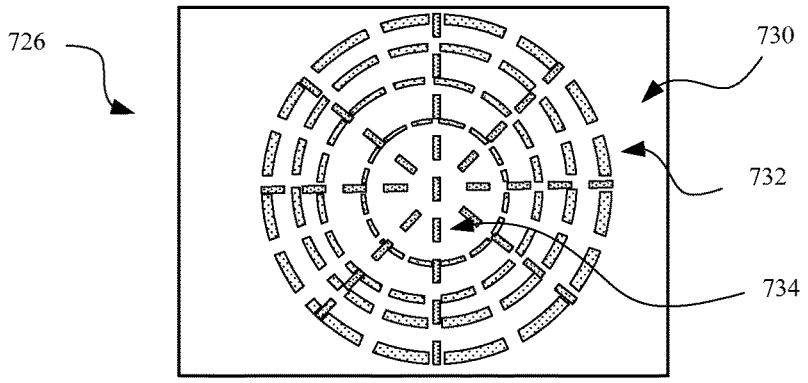
FIG. 12 illustrates an enlarged portion of an embodiment of a cap member having fibers aligned in an orthotropic configuration.
Figure 13:
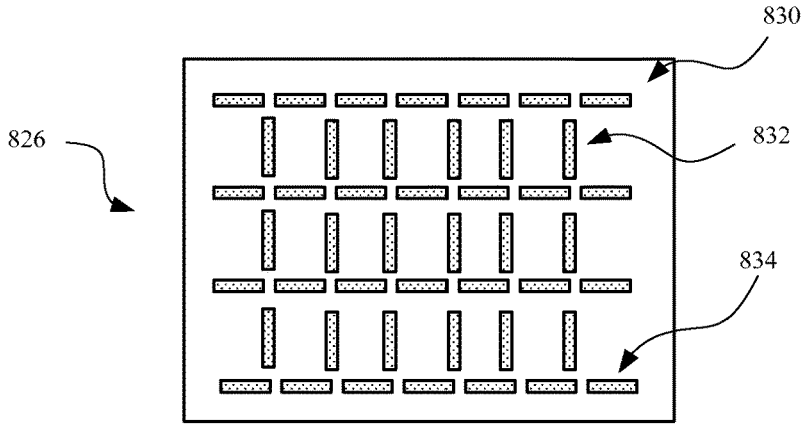
FIG. 13 illustrates an enlarged portion of an alternate embodiment of a cap member having fibers aligned in a different orthotropic configuration.
Figure 14:
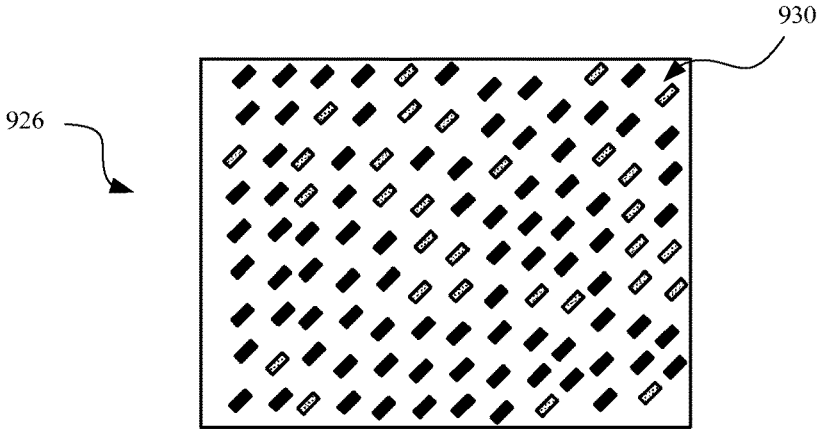
FIG. 14 illustrates an enlarged portion of an embodiment of a cap member having fibers aligned in a diagonal configuration.

FIGS. 12-14 illustrate enlarged portions of cap members showing various patterns or configurations of fibers within the cap members. The fibers shown in FIGS. 12-14 may be part of a composite material, including carbon fiber. FIG. 12 illustrates cap member 726 having fibers 730 generally in an orthotropic configuration. For instance, first fibers 732 include a generally circular pattern while second fibers 734 are configured generally in a linear pattern. FIG. 13 illustrates cap member 826 having fibers 830 arranged in a different orthotropic configuration. For instance, first fibers 832 are generally aligned in a first direction (e.g., vertical) while second fibers 834 are generally aligned in a direction perpendicular to the first direction (e.g., horizontal). FIGS. 12 and 13 may be used to resist load forces created during a drop event in from multiple directions. Also, in other embodiments, the fibers (e.g., fibers 730 or fibers 830) may be arranged in a random pattern, i.e., with no discernable arrangement.

FIG. 14 illustrates cap member 926 having fibers 930 in a substantially diagonal direction. Fibers 930 oriented in this manner may be beneficial to resist a drop event instances when an electronic device is dropped and a corner (e.g., first corner 152, in FIG. 2). In this manner, the load force created during the drop enters the electronic device in the direction of fibers 930.

Figure 15:
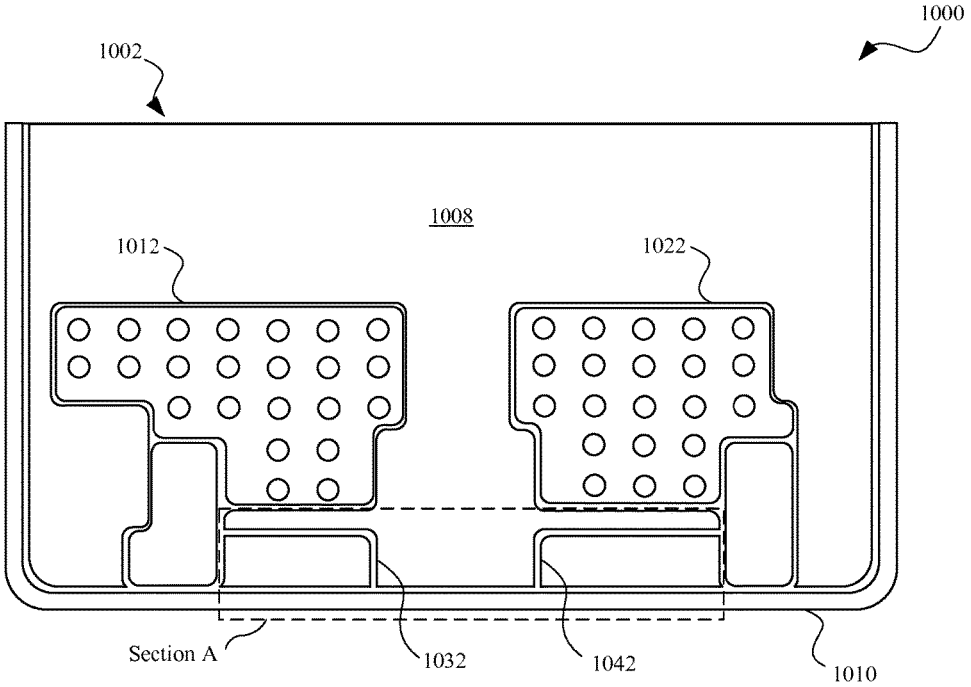
FIG. 15 illustrates a portion of an electronic device having an enclosure with a first rub structure and a second rib structure, both of which integrally formed to a rear portion and first sidewall of the enclosure, in accordance with the described embodiments.

Additional structural improvements may be integrated into an electronic device. In particular, the improvements can resist cracking of a sidewall and/or an anodization layer applied to an enclosure. For example, FIG. 15 illustrates a portion of electronic device 1000 having enclosure 1002 with first rib structure 1012 and second rib structure 1022, both of which integrally formed to rear portion 1008 and first sidewall 1010 through material removal techniques previously described. Also, enclosure 1002 may include third rib portion 1032 and fourth rib portion 1042 integrally formed to rear portion 1008 first sidewall 1010. Also, third rib portion 1032 is integrally formed to first rib structure 1012 and fourth rib portion 1042 is integrally formed to second rib structure 1022. In this manner, when electronic device is dropped in manner in which first sidewall 1010 collides with an object, third rib portion 1032 and fourth rib portion 1042 provide structural support to first sidewall 1010 as well as an anodization layer (not shown). Further, third rib portion 1032 and fourth rib portion 1042 may further resist twisting and/or bending in portions of enclosure 1002 proximate to third rib portion 1032 and fourth rib portion 1042.

Figure 16:
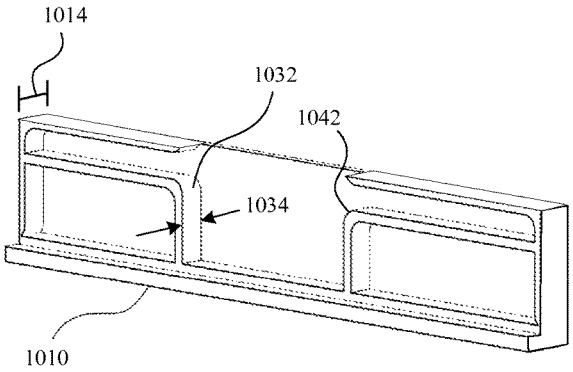
FIG. 16 illustrates an isometric view of the area denoted in FIG. 15 as Section A, showing a third rib portion and a fourth rib portion integrally formed with a rear portion and a sidewall of an enclosure, in accordance with the described embodiments.

FIG. 16 illustrates a isometric view of the area denoted in FIG. 15 as Section A, showing third rib portion 1032 and fourth rib portion 1042 integrally formed in the manner described in FIG. 15. To provide the structural support described, third rib portion 1032 and fourth rib portion 1042 may include a thickness similar to that of first rib structure 1012. For example, third rib portion 1032 includes thickness 1034 substantially similar to thickness 1014 of first rib structure 1012.

Figure 17:
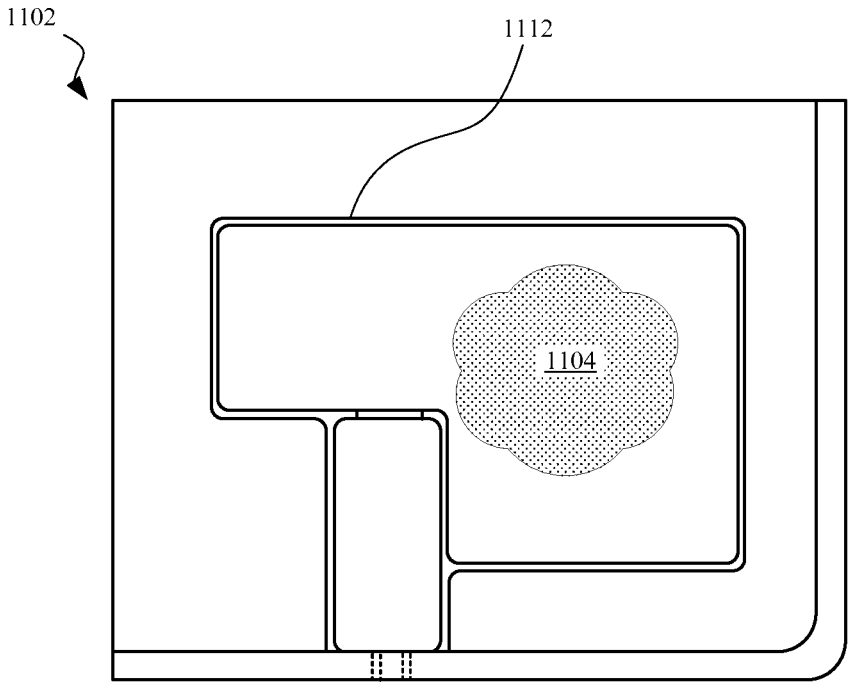
FIG. 17 illustrates a top view of an embodiment of a rib structure having an acoustic foam positioned within the rib structure.
Figure 18:
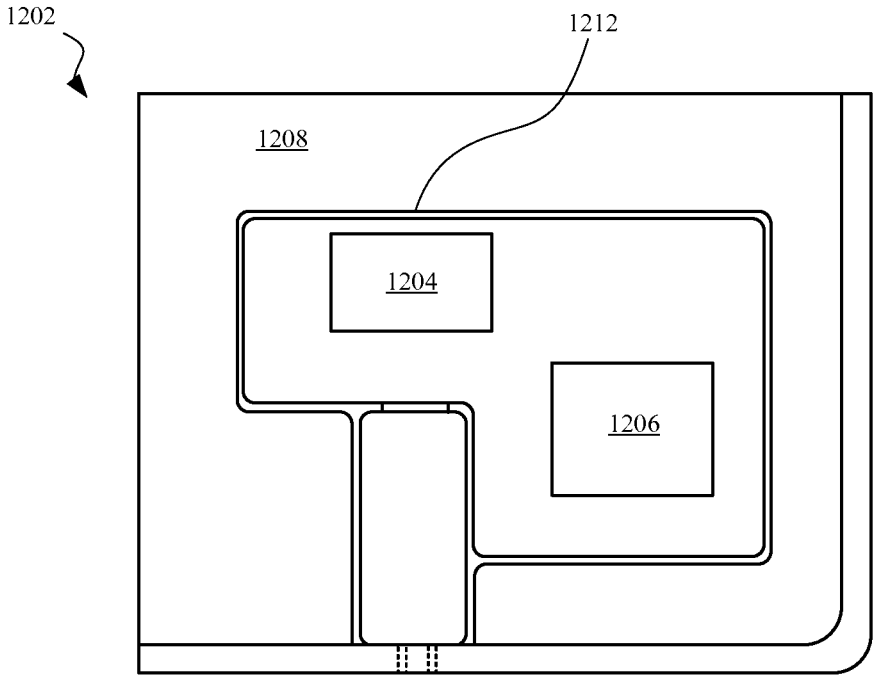
FIG. 18 illustrates a top view of an embodiment of a rib structure having a component positioned within the rib structure.

Previous embodiments illustrate various structures within a rib structure used to provide structural and acoustic enhancements. However, other structures may be positioned within a rib structure. For example, FIG. 17 illustrates an enlarged portion of enclosure 1102 having acoustic foam 1104 within rib structure 1112. Acoustic foam 1104 may be formed from materials such as polyether or polyester. This may be used to provide additional acoustical enhancements, such as sound absorption, in order to configure audio devices which output the same sound levels. Also, acoustic foam 1104 may provide discrete stiffening to a cap member (not shown) when the cap member is adhesively secured to rib structure 1112. Also, in some embodiments, acoustic foam 1104 is a cored laminate construction having a honeycomb configuration. In some embodiments, the porous regions of acoustic foam 1104 are configured in a closed-cell configuration, thereby reducing the overall weight of enclosure 1102 and also providing increased stiffness. FIG. 18 illustrates an enlarged portion of enclosure 1202 having first component 1204 and second component 1206 within rib structure 1212. First component 1204 and second component 1206 may be selected from a memory device, a power supply, or a processor. In this manner, an electronic device may include an overall reduced footprint by using space within rib structure 1212 for components. Also, first component 1204 and second component 1206 may be adhesively secured to rear portion 1208 in order to provide structure support to enclosure 1202.

Figure 19:
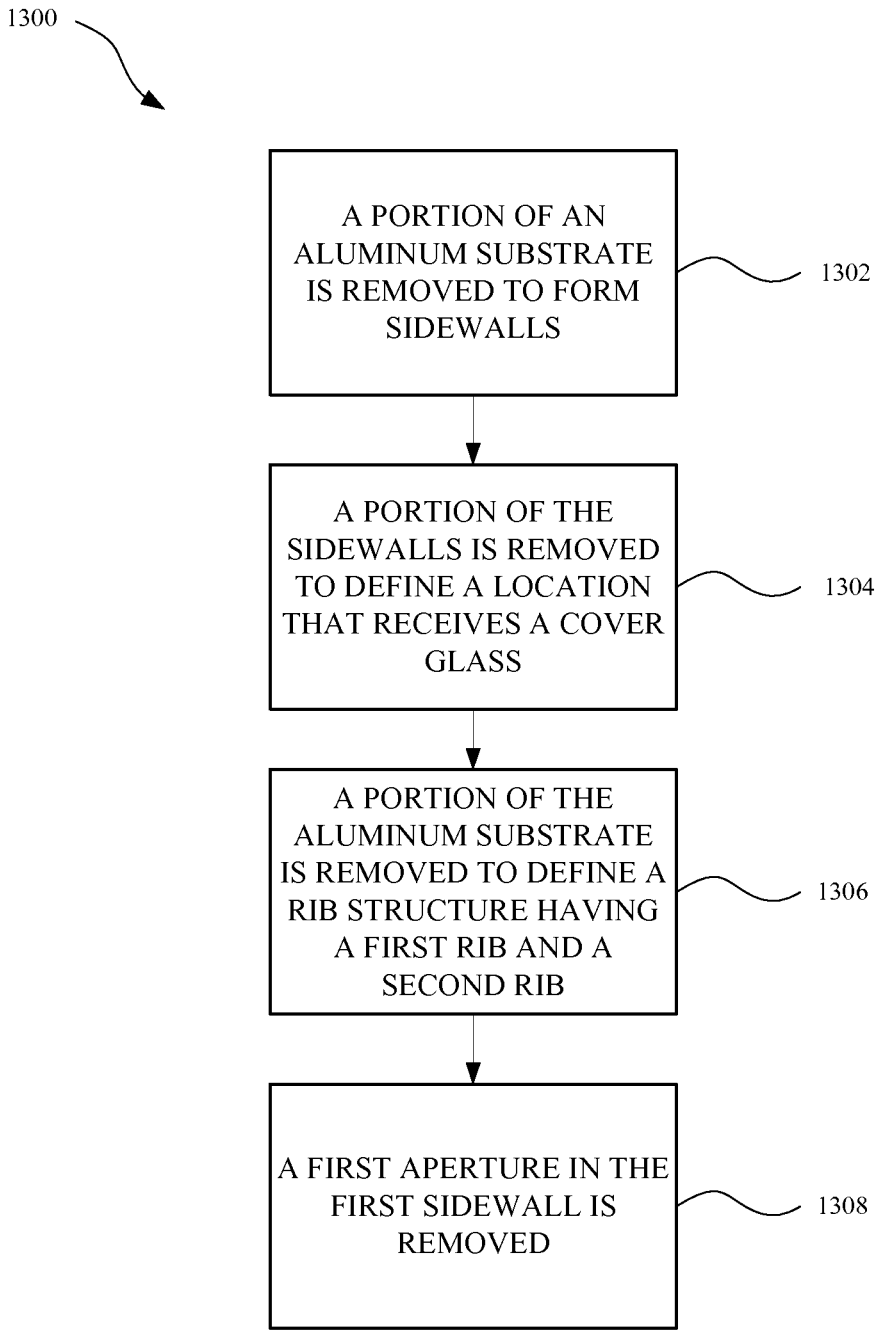
FIG. 19 illustrates a flowchart showing a method for forming an enclosure of an electronic device.

FIG. 19 illustrates a flowchart 1300 showing a method for forming an enclosure of an electronic device. In step 1302, a portion of an aluminum substrate is removed to form sidewalls. In some embodiments, the sidewalls have a first sidewall. In step 1304, a portion of the sidewalls is removed to define a location that receives a cover glass. In step 1306, a portion of the aluminum substrate is removed to define a rib structure having a first rib and a second rib. In some embodiments, the first rib and second rib are adapted to receive an audio device and a cap member. Also, in some embodiments, the first rib and the second rib both engage the first sidewall. Further, in some embodiments, a flange member may be machined within first rib and/or second rib to adhesively secure the cap member. Also, in some embodiments, an underpass may be machined within the first rib and/or second rib. Also, in some embodiments, a third rib may be integrally formed with at least the second rib; the third rib may be configured to be free of contact with the audio device and the cap member. In step 1308, a first aperture in the first sidewall is removed. In some embodiments, the first aperture opens into a location between the first rib and the second rib. The first aperture may define an opening for the audio device to emit sound from the electronic device.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device, comprising:

an enclosure comprising:

a plurality of ribs comprising:

a first rib structure engaged with a sidewall of the enclosure and at least partially defining a first chamber;

a second rib structure at least partially defining a second chamber different from the first chamber; and a shared rib defining a portion of both the first chamber and the second chamber;

an audio device comprising a cover in contact with and forming an acoustic seal over a top of the first rib structure, the audio device defining:

a first opening configured to project first sound waves in a first direction towards an area of the sidewall where a speaker opening is located; and a second opening configured to project second sound waves in a second direction opposite the first direction and towards the shared rib; and a cap member covering the second rib structure.

2. The electronic device as recited in claim 1, further comprising an underpass through the first rib structure, wherein the underpass opens the first chamber to the second chamber.

3. The electronic device as recited in claim 2, wherein when the audio device is positioned within the first chamber, the audio device is capable of emitting sound through the underpass.

4. The electronic device as recited in claim 1, further comprising means for securing the audio device to the first rib structure, and means for securing the cap member to the second rib structure.

5. The electronic device as recited in claim 4, wherein the means for securing the cap member to the second rib structure comprises a flange receiving the cap member and an adhesive securing the cap member to the flange.

6. The electronic device as recited in claim 5, wherein the cap member comprises a composite material and defines a plurality of protrusions adhesively secured to the enclosure.

7. The electronic device as recited in claim 5, further comprising:

an additional plurality of ribs comprising:

a third rib structure engaged with the sidewall of the enclosure and at least partially defining a third audio chamber; and a fourth rib structure at least partially defining a fourth chamber different from the third chamber; and an additional shared rib defining a portion of both the third chamber and the fourth chamber;

an additional audio device comprising an additional cover in contact with and forming an additional acoustic seal over a top of the third rib structure; and a cap member covering the fourth rib structure.

8. The electronic device of claim 1, wherein the cap member forms an acoustic seal over a top of the second chamber.

9. The electronic device of claim 1, wherein a top of the first rib structure and a top of the second rib structure together define a single plane.

10. An electronic device, comprising:

an enclosure, comprising:

a plurality of sidewalls integrally formed around an outer peripheral portion of the enclosure and comprising a sidewall having an aperture therethrough;

a first plurality of ribs integrally formed on a rear portion of the enclosure and including:

a first rib structure engaged with the sidewall of the enclosure and at least partially defining a first chamber;

a second rib structure at least partially defining a second chamber different from the first chamber; and a shared rib defining a portion of both the first chamber and the second chamber and positioned opposite the aperture in the sidewall;

a speaker module comprising:

a cover in contact with and forming an acoustic seal over a top of the first rib structure;

a first wall defining a first opening that faces the aperture in the sidewall; and a second wall defining a second opening that faces the shared rib; and a cap member in contact with and forming an acoustic seal over a top of the second rib structure.

11. The electronic device as recited in claim 10, wherein the cap member is adhesively secured to the second rib structure.

12. The electronic device as recited in claim 10, further comprising an underpass in the shared rib, the first underpass opening to the first chamber and the second chamber.

13. The electronic device as recited in claim 12, wherein the speaker module emits sound through the aperture and the underpass.

14. The electronic device of claim 10, wherein a top of the first rib structure and a top of the second rib structure together define a single plane.

15. The electronic device of claim 10, wherein the first wall and the second wall are substantially parallel to one another.

16. The electronic device of claim 10, wherein:

the first wall is substantially parallel to the sidewall; and the second wall is substantially parallel to the shared rib.

17. A method comprising:

forming an enclosure, comprising:

removing a portion of an aluminum substrate to form a plurality of sidewalls, the plurality of sidewalls having a first sidewall;

removing a portion of the plurality of sidewalls to define a location that receives a cover glass;

removing a portion of the aluminum substrate to define a continuous rib structure defining:

a first rib structure at least partially defining a first chamber;

a second rib structure at least partially defining a second chamber; and a third rib structure defining a portion of each of the first and the second chambers, wherein the first, second, and third rib structures each extend substantially a same height above a back surface of the enclosure;

forming an aperture in the first sidewall, the aperture opening into the first chamber; and removing a portion of the third rib structure to define an underpass in the third rib structure while maintaining the first, second, and third rib structures at the same height above the back surface of the enclosure;

attaching an audio device to the first rib structure such that a first opening in the audio device faces the aperture and a second opening in the audio device faces the third rib structure; and attaching a cap member to the second rib structure to acoustically seal the second chamber.

18. The method as recited in claim 17, further comprising:

removing a portion of the second rib structure to define a flange member; and securing the cap member to the flange member using an adhesive.

19. The method as recited in claim 17, wherein the aperture allows sound from the audio device to escape the enclosure.

20. The method as recited in claim 17, wherein attaching the audio device to the first rib structure acoustically seals the first chamber.

* * * * *